US009782973B2

(12) United States Patent
LeFevre et al.

(10) Patent No.: US 9,782,973 B2
(45) Date of Patent: Oct. 10, 2017

(54) METHOD AND APPARATUS FOR MITIGATING PARTICULATE SETTLING IN AN INK HANDLING SYSTEM

(71) Applicant: Xerox Corporation, Norwalk, CT (US)

(72) Inventors: Jason M. LeFevre, Penfield, NY (US); Steven M. Russel, Bloomfield, NY (US); David A. VanKouwenberg, Avon, NY (US); Timothy P. Foley, Marion, NY (US); Frank B. Tamarez Gomez, Belfast (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/934,245

(22) Filed: Nov. 6, 2015

(65) Prior Publication Data

US 2017/0129247 A1 May 11, 2017

(51) Int. Cl.
*B41J 29/38* (2006.01)
*B41J 2/175* (2006.01)

(52) U.S. Cl.
CPC .. *B41J 2/17513* (2013.01); *B41J 2002/17516* (2013.01)

(58) Field of Classification Search
None
See application file for complete search history.

(56) References Cited

U.S. PATENT DOCUMENTS 4,318,114 A 3/1982 Huliba
4,614,948 A 9/1986 Katerberg et al.
6,039,442 A 3/2000 Hagiwara et al.
6,343,857 B1 2/2002 Cowger
6,695,441 B2 2/2004 Asano
7,140,724 B2 11/2006 Otis et al.
7,770,990 B2 8/2010 Nagashima
8,016,400 B2 9/2011 Silverbrook
8,740,363 B2 6/2014 Adiletta et al.
2004/0061747 A1 4/2004 Nakao et al.
2005/0258288 A1* 11/2005 Dalziel ..... A61K 9/14 241/172
2008/0229819 A1* 9/2008 Mayleben ..... F04B 49/06 73/304 C
2012/0013659 A1 1/2012 Nishimura
2013/0021418 A1* 1/2013 Lu ..... B41J 2/17593 347/88

* cited by examiner

*Primary Examiner* — Erica Lin
(74) *Attorney, Agent, or Firm* — Gibb & Riley, LLC

(57) ABSTRACT

Printer structures include a controller, a marking engine operatively (meaning directly or indirectly) connected to the controller, and a container connected to the marking engine. The marking engine applies marking material to print media, and the container stores that marking material. The container can include a flexible bladder storing the marking material, and an actuator structure operatively connected to the controller. The actuator structure contacts the flexible bladder and periodically moves portions of the bladder to periodically mix the marking material as controlled by the controller (based on the marking engine being idle for a previously established amount of time). Alternatively, the actuator structure contacts the container can periodically rotate the container to periodically mix the marking material as controlled by the controller.

20 Claims, 9 Drawing Sheets

METHOD AND APPARATUS FOR MITIGATING PARTICULATE SETTLING IN AN INK HANDLING SYSTEM

BACKGROUND

Systems and methods herein generally relate to printing systems that use liquid marking materials, and more particularly to methods and apparatuses for mitigating particulate settling in such liquid marking material handling systems.

When a printing device is not in use for extended periods of time (often greater than two weeks) marking material sedimentations can occur. The marking material sedimentation causes some elements in the marking engine to clog, which ultimately forces the customer to be down for long periods of time. Additionally, depending on the type of clogging and the location of the clog, the failure mode can be costly to repair, especially if the marking material sediment enters the marking engine head, filters, or other marking material handling elements.

For example, marking material clogging can occur in a sub-tank, along with the main tank. If a liquid marking material printing device is unused for a multi-week period, the sub-tank clogging can occur and ink replacement or cleaning can be required. Sub-tanks are above the printing device head and may cause liquid marking material to drop down to the head. Filters and valves between the sub-tank and the head may also get clogged during the purging sequence. When some printing machines are shut down and idle, there may no longer be any additional source of energy delivered to the machine, other than what is contained within the machine.

One type of liquid marking material printing system that frequently encounters problems with ink sedimentation is a magnetic ink character recognition (MICR) system. In MICR systems various tanks and sub-tanks are very sensitive to ink particulate settling issues, which can result in clogged filters, nozzles, jets, etc.

SUMMARY

Exemplary printer structures herein can include (among other components) a controller, a marking engine operatively (meaning directly or indirectly) connected to the controller, a container connected to the marking engine, etc. The marking engine applies marking material to print media, and the container stores that marking material. The container can include a flexible bladder storing liquid marking material, and an actuator structure operatively connected to the controller.

The actuator structure contacts the flexible bladder and periodically moves portions of the bladder to periodically mix the liquid marking material as controlled by the controller (if the marking engine has been idle for a previously established amount of time). Thus, the actuator structure deflects walls of the bladder to change the shape of the bladder when moving portions of the bladder, and this frees any particles of marking material that may have become attached to the wall of the bladder. For example, the actuator structure can include a piston that pushes against the bladder when moving portions of the bladder. The actuator structure can be, for example, an electromagnetic actuator structure, a pneumatic actuator structure, a hydraulic actuator structure, etc. Additionally, the printer can further include a battery and/or a pressurized air or liquid tank that power the actuator structure when the printer is disconnected from a continuous power source.

Other printer structures herein can include (among other components) a controller, a marking engine operatively (meaning directly or indirectly) connected to the controller, and a container connected to the marking engine. The marking engine applies marking material to print media, and the container stores that marking material, and an actuator structure operatively connected to the controller. The actuator structure contacts the container and periodically rotates the container to periodically mix the marking material as controlled by the controller (if the marking engine has been idle for a previously established amount of time). When rotating the container, the actuator structure can, for example, rotate the container one-half a complete revolution in each time period.

In one example, the container can include a crankshaft connected to the actuator structure. The crankshaft has an axle positioned in the center of the container, and a connection to the actuator that is offset from the axle, and this offset allows the crankshaft to translate the linear movement of the actuator into rotational movement of the container. For example, the actuator structure can be an electromagnetic actuator structure, a pneumatic actuator structure, a hydraulic actuator structure, etc. Additionally, the printer can further include a battery and/or a pressurized air or liquid accumulator tank that powers the actuator structure when the printer is disconnected from a continuous power source.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
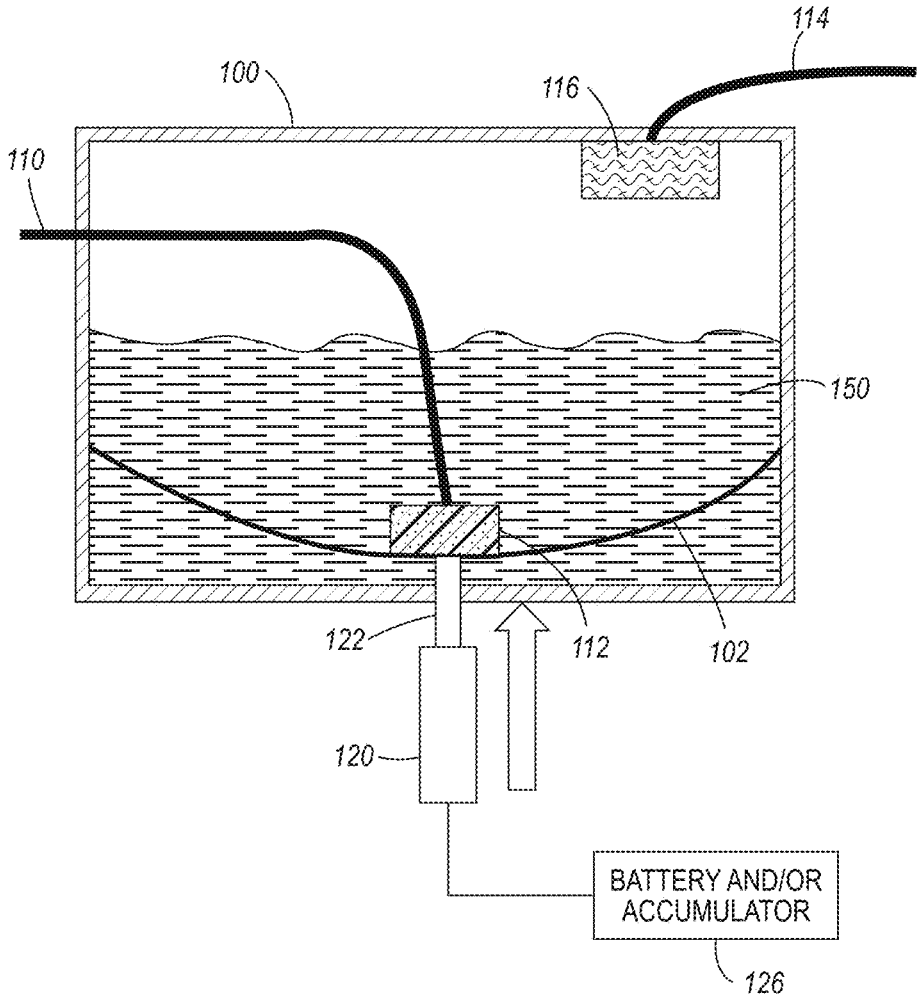
FIG. 1 is a schematic side-view diagram illustrating devices herein.

As mentioned above, when a printing device that prints using liquid marking materials is not in use for extended periods of time, liquid marking material sedimentations can occur. Sedimentation causes some elements in the marking engine to clog, which ultimately forces the customer to be down for long periods of time. Also, clogging can occur in many different locations, such as a sub-tank and/or main tank.

The systems and methods described herein provide solutions that include using a liquid marking material tank with a bladder (within which the liquid marking material is contained) that can be manipulated using a linear actuator such that the "low-point" of the bladder can be moved up, preventing the sedimentation of the marking material. In this fashion, the low and high points of the flexible bladder surface of the container can change periodically so that "settling" on any one surface is prevented.

In one example, the flexible bladder starts out in the linear actuator "retracted" state, stays in that position for a time period (e.g., 1st week) and then moves to the linear actuator "extended" position for the same period of time (e.g., 2nd week) after which the linear actuator returns to the "retracted" position (e.g., 3rd week). This cyclic positioning of the internal surface of the ink container prevents ink from settling on the low point of the tank because the low point changes by movement of the actuator. Flexible tubing can be used to attach the ink pickup, such that movement of the pickup is accommodated when the bladder orientation changes.

Similarly, in other structures, an air actuated reciprocating cylinder can facilitate the rotation of rigid marking material tanks from a nominal upright "retracted" position to a relatively inverted position (e.g., "extended" position, e.g., 150° to 180° of rotation) once a time period (e.g., once a week). In this way, the rigid tank is inverted (half-rotation) from its previous rotational position once each time period, and the rigid tank makes a full rotation every two time periods (e.g., a half-rotation is executed in each time period).

The actuators herein can be any form of actuator, including hydraulic, pneumatic, electro-mechanical, etc. Further, these printers can include batteries and/or accumulator tanks to allow the actuators to operate even when the printer is disconnected from external power sources.

Therefore, for example, an air "accumulator" tank can be included in such structures to store compressed air that would be used to power pneumatic actuators when all other sources of power are removed from the machine. Air mechanisms can use a series of valves arranged in such a way as to generate reciprocal movement of an air cylinder. The frequency of the reciprocal movement can be varied, for example, by manipulating a bleeder valve that meters the amount of air flowing through the system. The air accumulator tank (or battery) can be sufficiently large as to allow many dozens of cycles to occur before the stored air (or battery power) is depleted.

Further, with structures herein, ink and/or vent line plumbing can be ported out the side or top of the tank through flexible tubing that can then be connected to the other tanks and/or printing heads. In cases where there are both an ink input and an ink output, an additional line can be added. In cases where no vent line is needed, the vent line port may not be utilized. Such tubing going to and from the tanks can be flexible lines, so as to allow unrestricted rotation and/or expansion of the tank. The "full" level of the tank can be set such that the volume of liquid displaced by the manipulation of the bladder still leaves an air-space at the top of the tank, regardless of the position of the actuator.

Figure 8:
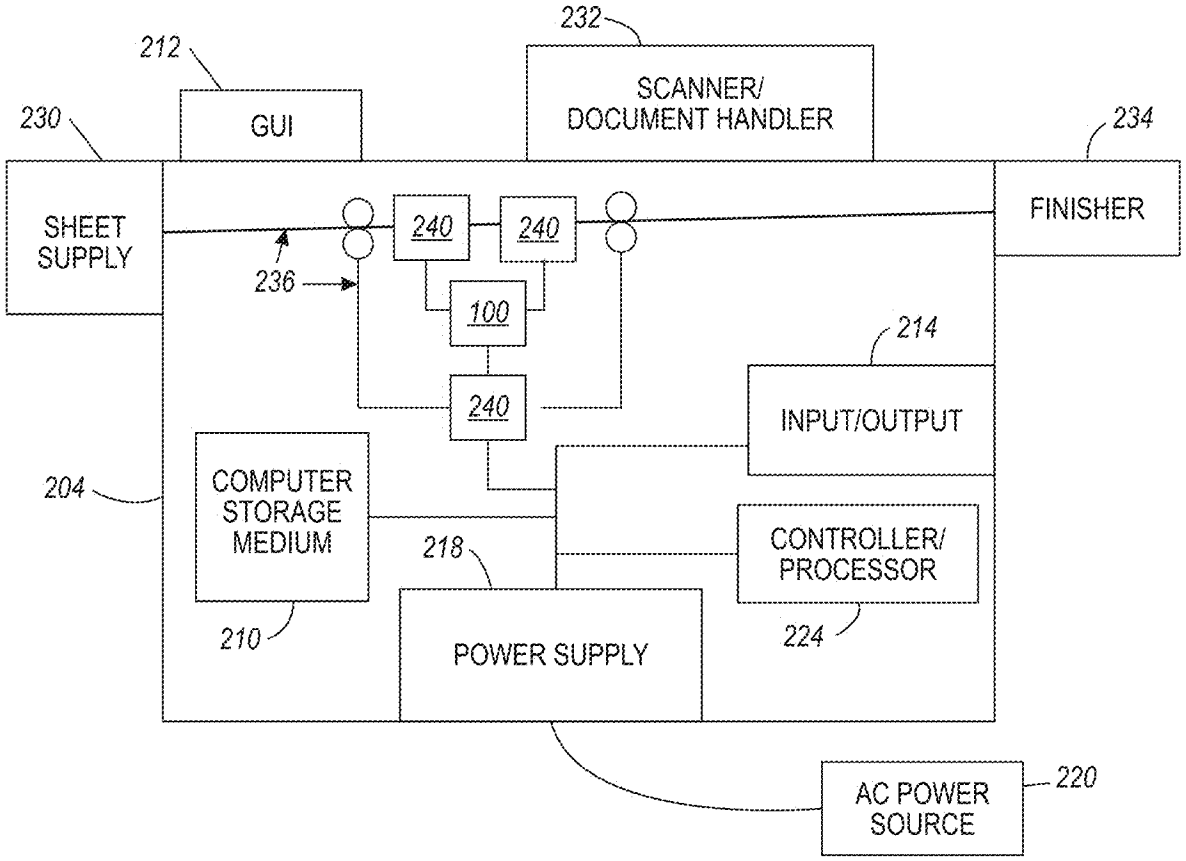
FIG. 8 is a schematic side-view diagram illustrating devices herein.

As shown in side view in FIG. 1, the container 100 can include a flexible bladder 102 storing the marking material 150, and an actuator structure 120 operatively connected to a controller 224 (see FIG. 8). The actuator structure 120 contacts the flexible bladder 102 and periodically moves portions of the bladder 102 to periodically mix the marking material 150 as controlled by the controller 224 (if the marking engine 240 has been idle for a previously established amount of time).

For example, the actuator structure 120 can be an electromagnetic actuator structure 120, a pneumatic actuator structure 120, a hydraulic actuator structure 120, etc. Additionally, the printer can further include a battery and/or a pressurized air or liquid tank 126 that power the actuator structure 120 when the printer is disconnected from a continuous power source. Thus, in one example, when the machine is in an enabled state, the "house" air can fill the accumulator tank 126, which can store the air for times when the machine is disconnected from all sources of energy. A check-valve can keep air from escaping the "Accumulator" tank when "house" air is removed. From that point forward, until "house" air is restored, the pneumatic tank flipping and bladder movement mechanism 120 can be run from air supplied from the accumulator tank 126.

Figure 2:
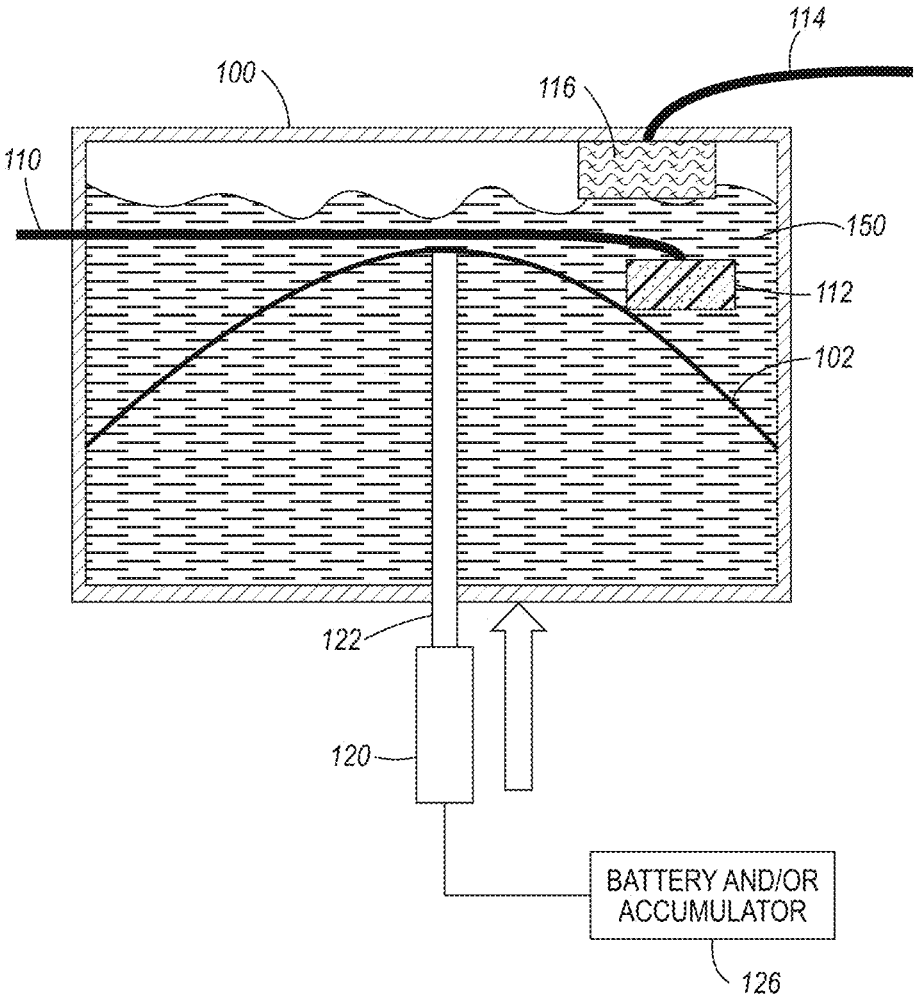
FIG. 2 is a schematic side-view diagram illustrating devices herein.

FIG. 2 shows the "extended" position of the bladder 102, and these structures will alternate between the positions shown in FIG. 1 and FIG. 2 within each idle time period. Alternatively, the actuator can move from the retracted position (FIG. 1) to the extended position (FIG. 2) and back to the retracted position (FIG. 1) in a continuous movement in a single idle time period to agitate the liquid marking material.

Figure 3:
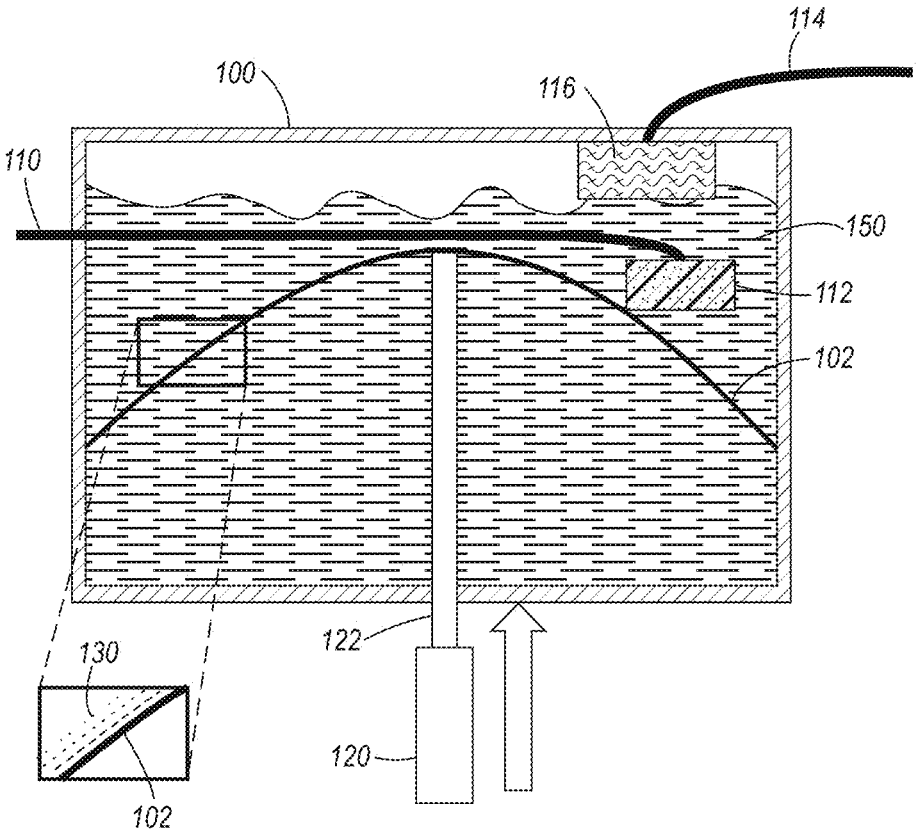
FIG. 3 is a schematic side-view diagram illustrating devices herein.

FIG. 3 illustrates an expanded view of a portion of the flexible bladder 102 and how the actuator structure 120 deflects the wall of the bladder 102 to change the shape of the bladder 102 when moving portions of the bladder 102. As shown in FIG. 3, this dislodges particles 130 of the marking material 150 that may be adhered to the wall of the bladder 102. As also shown in FIG. 3, the bladder 102 can be stretched by the actuator 120 extending, which causes particulate 130 on the surface of the bladder 102 break free from the wall of the bladder 102. This stretching of the bladder 102 releases the particulates 130 from the surface of the bladder 102 and allows the particulates 130 to migrate back into the fluid suspension 150. Additionally, the actuator 120 can move swiftly (e.g., at a speed exceeding 0.1 m/sec; 0.25 m/sec; 0.5 m/sec, etc.) such that the swift movement also causes agitation of the fluid contained in the tank and mitigates the tendency of the particulates 130 to "settle" out.

As shown in the FIGS. 1-3, the actuator structure 120 can include a piston 122 that pushes against the bladder 102 when moving portions of the bladder 102. The actuator structure 120 can be, for example, an electromagnetic actuator structure 120, a pneumatic actuator structure 120, a hydraulic actuator structure 120, etc. Additionally, the printer can further include a battery and/or a pressurized air or liquid tank 126 that power the actuator structure 120 when the printer is disconnected from a continuous power source.

Figure 4:
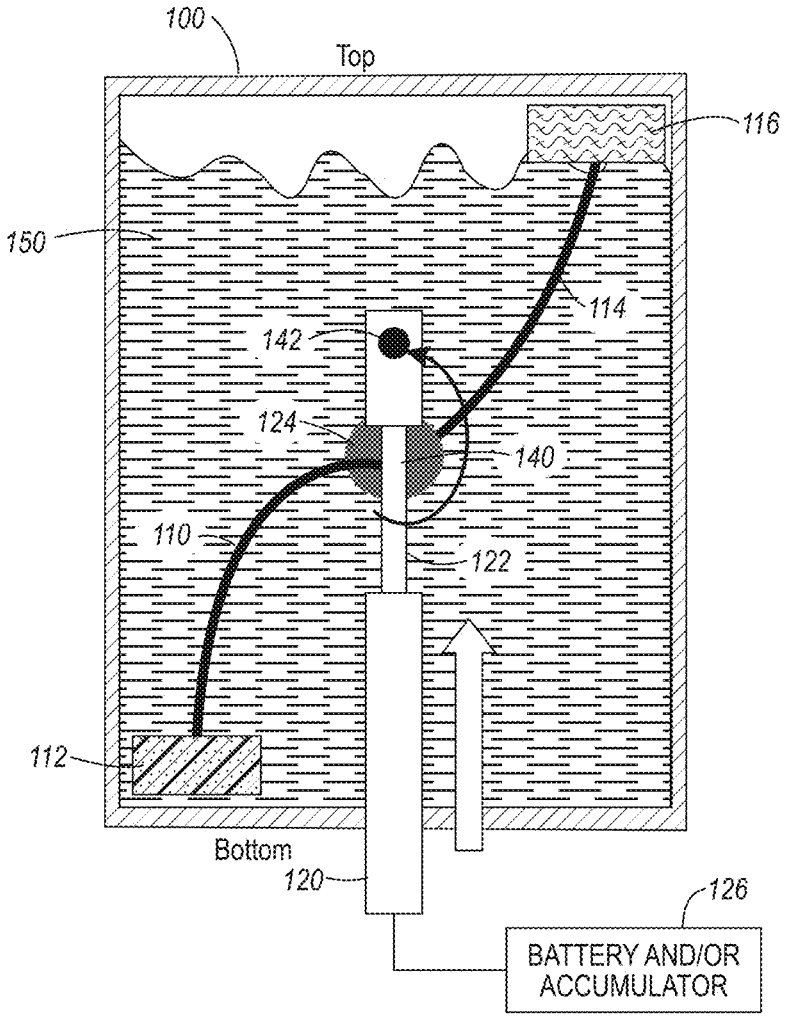
FIG. 4 is a schematic side-view diagram illustrating devices herein.
Figure 5:
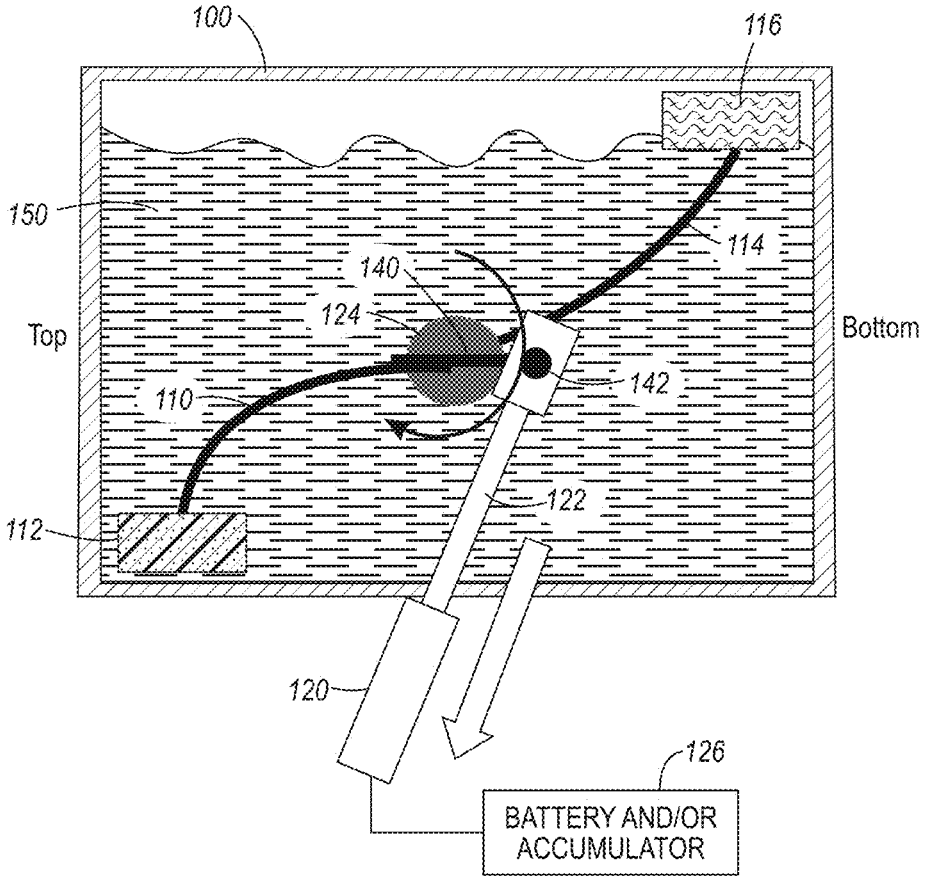
FIG. 5 is a schematic side-view diagram illustrating devices herein.
Figure 6:
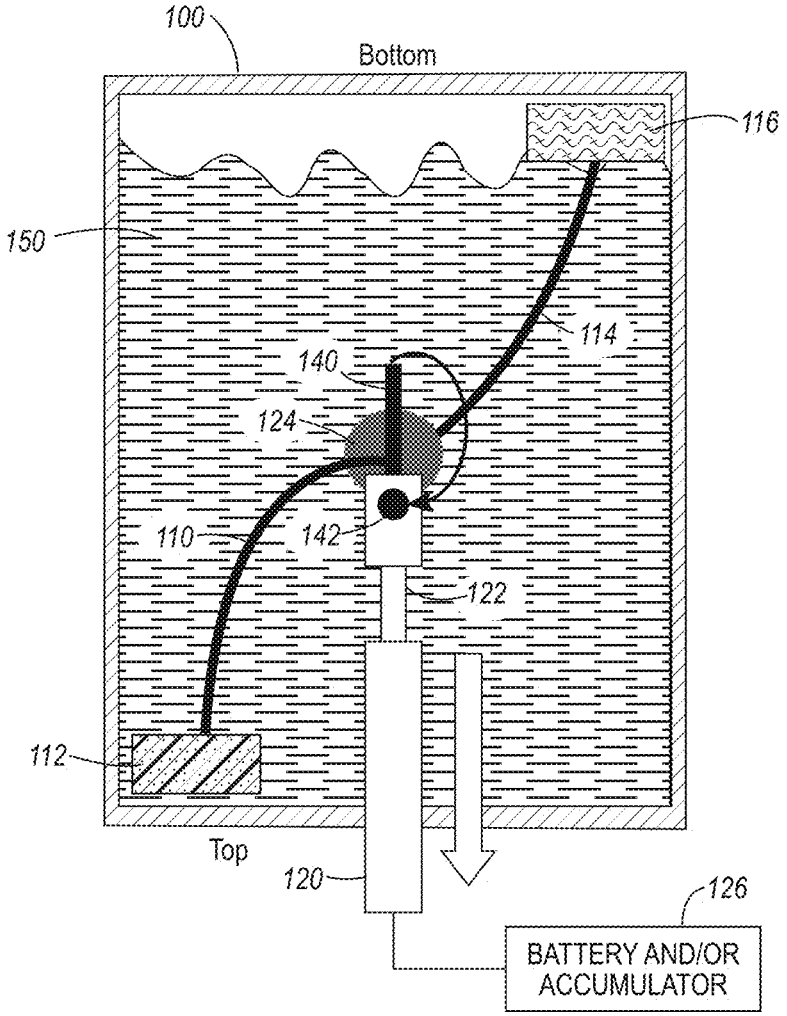
FIG. 6 is a schematic side-view diagram illustrating devices herein.

FIGS. 4-6 provide side views of a different structure that periodically rotates to prevent sedimentation. When rotating the container 100, the actuator structure 120 rotates the container 100 one-half a revolution in each time period (e.g. a half-rotation every week). This is shown in FIG. 4 where the actuator structure 120 is fully extended (as shown by the block arrow) and the arbitrarily named "top" of the container 100 is positioned at the top of FIG. 4, and the arbitrarily named "bottom" of the container 100 is positioned at the bottom of FIG. 4; in FIG. 5, where the actuator structure 120 is partially extended (as shown by the block arrow) and the "top" of the container 100 is positioned at the left of FIG. 5, and the "bottom" of the container 100 is positioned at the right of FIG. 5; and in FIG. 6 where the actuator structure 120 is fully retracted (as shown by the block arrow) and the "top" of the container 100 is positioned at the bottom of FIG. 6, and the "bottom" of the container 100 is positioned at the top of FIG. 6.

Thus, FIGS. 4-6 show how the weighted fluid pickup 112 moves inside the container 100, with the flexible hoses 110 allowing movement so that the weighted fluid pickup 112 always remains immersed in the liquid marking material 150. Additionally, the floating "vent" pickup 116 stays on the surface of the marking material fluid 150, and can remain in that state regardless of the orientation of the tank because of the flexible nature of the hose 114.

Also, FIG. 5 shows a side-view of the rotating container 100 when the container is in the middle of the process of being flipped one-half a revolution. The pneumatic arm 120 in FIG. 5 is partially extended and is shown in FIG. 5 as moving towards being fully retracted (as shown by the block arrow). Also, FIG. 6 shows the pneumatic arm 120 at the end of its stroke in the fully retracted position. In FIG. 6, the container 100 is shown as being inverted (e.g., 180 degrees) from its original orientation shown in FIG. 4, thus preventing any substantial marking material 150 settling.

In this way, the actuator structure 120 rotates the container 100 one-half of a complete revolution by changing from the position shown in FIG. 4 to the position shown in FIG. 6 (during the first time period) and eventually returning the container from the position shown in FIG. 6 to the position shown in FIG. 4 (during the subsequent second time period) so that the "top" of the container 100 is returned to the top of the drawing, and the "bottom" of the container 100 is returned to the bottom of the drawing. Alternatively, the actuator can move from the extended position (FIG. 4) to the retracted position (FIG. 6) and back to the extended position (FIG. 4) in a continuous movement in a single idle time period to agitate the liquid marking material.

Figure 7:
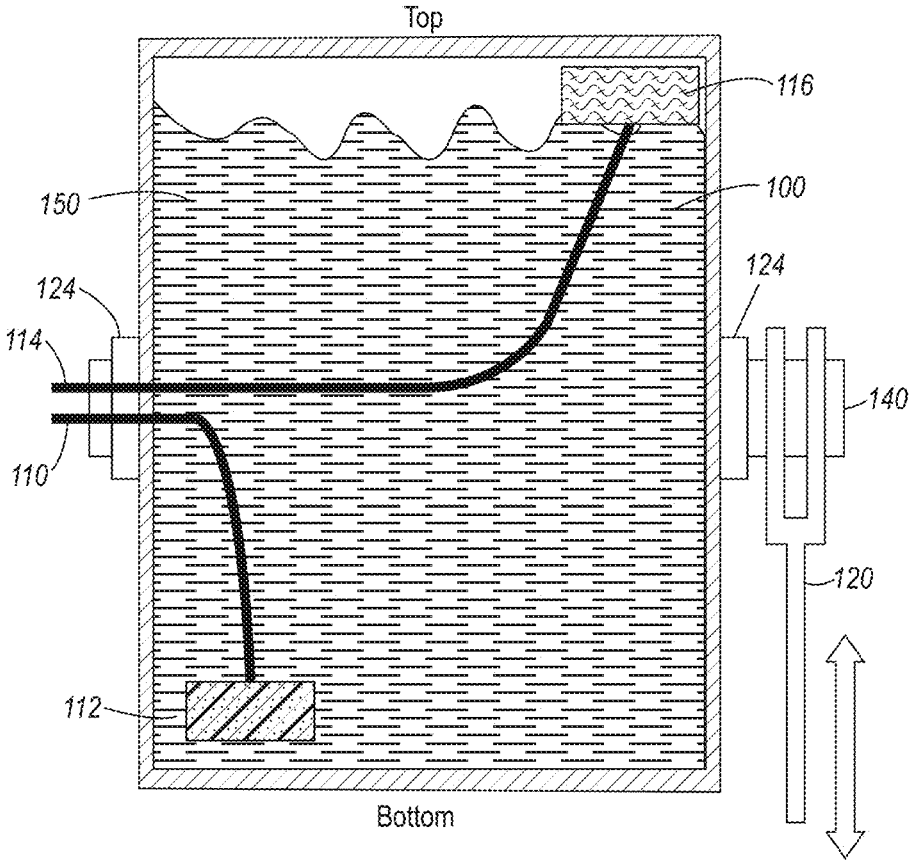
FIG. 7 is a schematic front-view diagram illustrating devices herein.

FIG. 7 shows a front-view of the rotating tank mechanism, which is a 90 degree rotated view from that shown in FIGS. 4-6. As shown in FIG. 7, the ink pickup 112 and the vent pickup 116 are both attached to flexible hoses 110, 114 that allow for movement inside the tank, so that the pickup 112 and vent 116 can re-orient themselves when the tank is flipped end-for-end. As shown in FIG. 7, both of the flexible lines 110, 114 are plumbed through the side wall of the tank where the crankshaft 124 and axle 140 are located. On the opposite end of the tank 100, the pneumatic mechanism 120 that rotates the tank is attached and moves as described above in FIGS. 4, 5, and 6.

Thus, as shown in FIGS. 4-7, some printer structures herein can include (among other components) a container 100 that stores the marking material 150, and an actuator structure 120 operatively connected to the controller 224. The actuator structure 120 contacts the container 100 and periodically partially or fully rotates the container 100 (as shown by the arrows in FIGS. 4-6) to periodically mix the marking material 150 as controlled by the controller 224 (if the marking engine 240 has been idle for a previously established amount of time).

In order to create rotational movement, the container 100 can include a crankshaft or similar device 124 connected to the actuator structure 120, and this is shown in side view in FIGS. 4-6 and front view in FIG. 7. As shown in FIGS. 4-7, the crankshaft 124 has an axle 140 positioned in the center of the container 100, and a connection 142 to the actuator structure 120 that is offset from the axle 140 (see FIGS. 4-6), and this offset allows the crankshaft 124 to translate the linear movement of the actuator structure 120 into rotational movement of the container 100.

FIG. 8, illustrates many components of printer structures 204 herein that can include (among other components) a controller 224, a marking engine 240 operatively (meaning directly or indirectly) connected to the controller 224, and a container 100 connected to the marking engine 240. The marking engine 240 applies liquid marking material 150 to print media, and the container 100 stores that liquid marking material 150.

This exemplary printing device 204, can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 8, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use liquid marking material, and are operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a liquid marking material (inks, plastics, organic material, etc.) to continuous media or sheets of media in two- or three-dimensional printing processes, whether currently known or developed in the future. The printing engines 240 can include, for example, devices that use inkjet printheads, contact printheads, three-dimensional printers, etc.

Figure 9:
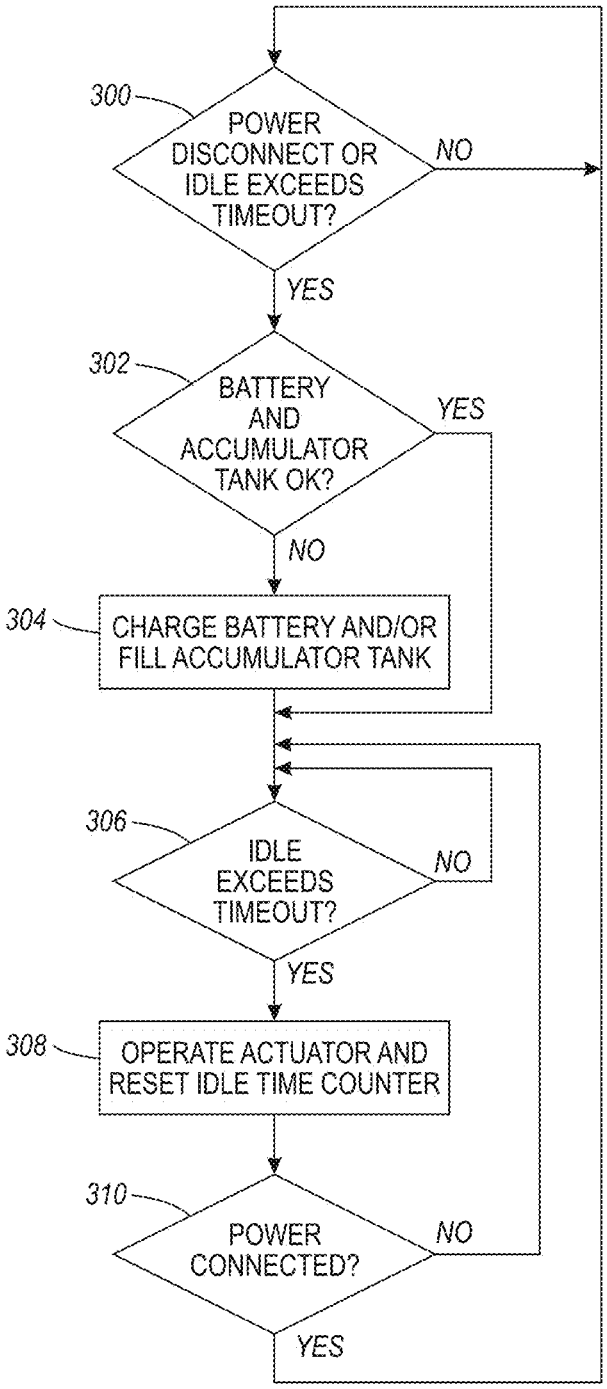
FIG. 9 is a flow diagram illustrating operations of devices herein.

FIG. 9 is a flowchart illustrating operations performed by devices herein. In item 300 in FIG. 9, the processor of the devices herein causes processing to loop back to wait until the power is being disconnected. Such monitoring in item 300 also detects when the device is unplugged (e.g., is disconnected from a continuous power source).

If the power is being disconnected or the idle time has exceeded the timeout, processing proceeds to item 302 and the devices herein check to see whether the battery and accumulator tank are within acceptable levels. If they are not, processing proceeds to item 304 where the battery is charged and or the accumulator tank is filled. More specifically, in item 304, if the printer is connected to a power supply or pressurized air supply, the battery and/or the accumulator tank are recharged. If the printer is connected to a power supply or pressurized air supply, a message is displayed on the graphic user interface of the printer instructing the user to recharge the battery and/or the accumulator tank.

If the battery and accumulator tank were found to be properly charged in item 302, processing proceeds to item 306 to loop back to wait until the idle time has exceeded the timeout. The timeout calculation in items 300 and 306 are the same. Once the idle time has exceeded the timeout, processing proceeds to item 308 where the actuator is operated to either push against the bladder or rotate the container, as described above. Also, in item 308, the idle time counter is reset to begin a new idle time period.

After the actuator is operated in item 308, item 310 checks weather the power is still connected. If the power is still connected, processing returns to item 300 to again wait until the power is disconnected or the idle exceeds the timeout. If the power is still not connected, processing proceeds back to item 306 to again wait until the idle time exceeds the timeout.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It can be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printer comprising:

a marking engine applying marking material to print media; and a container connected to said marking engine, said container storing said marking material, said container comprising:

a flexible bladder storing said marking material;

a movable pickup on said flexible bladder;

a flexible hose connected to said movable pickup; and an actuator structure contacting said flexible bladder, said actuator structure periodically moving portions of said flexible bladder to periodically mix said marking material.

2. The printer according to claim 1, said actuator structure deflecting walls of said flexible bladder to change a shape of said flexible bladder when moving portions of said flexible bladder.

3. The printer according to claim 1, said actuator structure comprising a piston pushing against said flexible bladder when moving portions of said flexible bladder.

4. The printer according to claim 1, said actuator structure comprising an electromagnetic actuator structure, a pneumatic actuator structure, or a hydraulic actuator structure.

5. The printer according to claim 1, further comprising at least one of a battery and a pressurized tank operating said actuator structure when said printer is disconnected from a continuous power source.

6. A printer comprising:

a controller;

a marking engine operatively connected to said controller, said marking engine applying marking material to print media; and a container connected to said marking engine, said container storing said marking material, said container comprising:

a flexible bladder storing said marking material;

a movable pickup on said flexible bladder;

a flexible hose connected to said movable pickup; and an actuator structure operatively connected to said controller, said actuator structure contacting said flexible bladder, said actuator structure periodically moving portions of said flexible bladder to periodically mix said marking material as controlled by said controller based on said marking engine being idle for a previously established amount of time.

7. The printer according to claim 6, said actuator structure deflecting walls of said flexible bladder to change a shape of said flexible bladder when moving portions of said flexible bladder.

8. The printer according to claim 6, said actuator structure comprising a piston pushing against said flexible bladder when moving portions of said flexible bladder.

9. The printer according to claim 6, said actuator structure comprising an electromagnetic actuator structure, a pneumatic actuator structure, or a hydraulic actuator structure.

10. The printer according to claim 6, further comprising at least one of a battery and a pressurized tank operating said actuator structure when said printer is disconnected from a continuous power source.

11. The printer according to claim 1, said movable pickup is free to move with said flexible bladder as an orientation of said flexible bladder changes when said actuator moves portions of said flexible bladder.

12. The printer according to claim 1, further comprising:

a floating vent pickup floating on said marking material; and a flexible vent hose connected to said floating vent pickup.

13. The printer according to claim 6, said movable pickup is free to move with said flexible bladder as an orientation of said flexible bladder changes when said actuator moves portions of said flexible bladder.

14. The printer according to claim 6, further comprising:

a floating vent pickup floating on said marking material; and a flexible vent hose connected to said floating vent pickup.

15. A printer comprising:

a marking engine applying liquid marking material to print media; and a container connected to said marking engine, said container storing said liquid marking material, said container comprising:

a flexible bladder storing said liquid marking material;

a movable fluid pickup on said flexible bladder, said movable fluid pickup being weighted to remain immersed in said liquid marking material;

a flexible pickup hose connected to said movable fluid pickup;

a floating vent pickup floating on said liquid marking material;

a flexible vent hose connected to said floating vent pickup; and an actuator structure contacting said flexible bladder, said actuator structure periodically moving portions of said flexible bladder to periodically mix said liquid marking material.

16. The printer according to claim 15, said actuator structure deflecting walls of said flexible bladder to change a shape of said flexible bladder when moving portions of said flexible bladder.

17. The printer according to claim 15, said actuator structure comprising a piston pushing against said flexible bladder when moving portions of said flexible bladder.

18. The printer according to claim 15, said actuator structure comprising an electromagnetic actuator structure, a pneumatic actuator structure, or a hydraulic actuator structure.

19. The printer according to claim 15, further comprising at least one of a battery and a pressurized tank operating said actuator structure when said printer is disconnected from a continuous power source.

20. The printer according to claim 15, said movable fluid pickup is free to move with said flexible bladder as an orientation of said flexible bladder changes when said actuator moves portions of said flexible bladder.

* * * * *